US010624429B2

(12) United States Patent
Lake

(10) Patent No.: US 10,624,429 B2
(45) Date of Patent: Apr. 21, 2020

(54) PORTABLE SHADE UMBRELLA

(71) Applicant: Steve Lake, Encinitas, CA (US)

(72) Inventor: Steve Lake, Encinitas, CA (US)

( * ) Notice: Subject to any disclaimer, the term of this patent is extended or adjusted under 35 U.S.C. 154(b) by 0 days.

(21) Appl. No.: 16/040,406

(22) Filed: Jul. 19, 2018

(65) Prior Publication Data

US 2019/0037984 A1 Feb. 7, 2019

Related U.S. Application Data

(60) Provisional application No. 62/541,547, filed on Aug. 4, 2017.

(51) Int. Cl.

| | |
|---|---|
| ***A45B 23/00*** | (2006.01) |
| ***E04H 15/28*** | (2006.01) |
| ***A45B 15/00*** | (2006.01) |

(52) U.S. Cl.

CPC ..... *A45B 23/00* (2013.01); *A45B 15/00* (2013.01); *E04H 15/28* (2013.01); *A45B 2023/0012* (2013.01)

(58) Field of Classification Search

CPC .. A45B 2023/0012; A45B 23/00; E04H 15/28
USPC ..... 135/98, 116; 248/171
See application file for complete search history.

(56) References Cited

U.S. PATENT DOCUMENTS

| | | | | | |
|---|---|---|---|---|---|
| 1,478,904 | A * | 12/1923 | Muzzi | E04H 15/28 | 135/120.2 |
| 3,213,868 | A * | 10/1965 | Forbes | E04B 1/3441 | 135/116 |
| 4,154,255 | A * | 5/1979 | Weaver | A45B 23/00 | 135/16 |
| 5,090,435 | A * | 2/1992 | Leclercq | A45B 23/00 | 135/116 |
| 5,884,645 | A * | 3/1999 | Chen | A45B 19/04 | 135/25.1 |
| 8,517,037 | B1 * | 8/2013 | Vazquez | E04H 1/12 | 135/143 |
| 8,991,412 | B2 * | 3/2015 | Holland | E04H 15/28 | 135/31 |
| 2006/0011226 | A1 * | 1/2006 | Santos | A45B 23/00 | 135/33.2 |

FOREIGN PATENT DOCUMENTS

| | | | | |
|---|---|---|---|---|
| DE | 19620295 C2 * | 3/2001 | ..... | A45B 19/10 |
| FR | 2172613 A5 * | 9/1973 | ..... | A45B 23/00 |

* cited by examiner

*Primary Examiner* — Noah Chandler Hawk
(74) *Attorney, Agent, or Firm* — Eric Hanscom

(57) ABSTRACT

A shade umbrella includes a top structure, an umbrella stand structure and a pole. The pole enables the separation of umbrella top structure into two components and posit of each other for ease of carrying and storing, and the umbrella stand structure attached to lower end of an umbrella pole which provides stability by parting horizontal and vertical loads. Further, the shade umbrella is portable, detachable and collapsible.

14 Claims, 19 Drawing Sheets

PORTABLE SHADE UMBRELLA

CROSS REFERENCE TO RELATED APPLICATIONS

This application claims priority to Provisional Application No. 62/541,547, filed Aug. 4, 2017, the contents of which are incorporated herein by reference.

STATEMENT REGARDING FEDERALLY SPONSORED RESEARCH OR DEVELOPMENT

This invention was not federally sponsored.

FIELD OF THE INVENTION

The present invention relates to the field of shade umbrellas. More particularly, the invention provides a portable shade umbrella for sporting events, beach and outdoor work environments. A preferred embodiment of the invention focuses on a portable, yet very stable, umbrella that can provide shade in a variety of locations, and yet be easily transported and set up quickly.

BACKGROUND OF THE INVENTION

Generally, shade umbrellas, also known as sun umbrellas or beach umbrellas, protect the user from direct sunlight and are used at sporting events, at beaches and parks, and outdoor work and "trade show" environments. When people travel to the beach, they often carry an umbrella for shade. Most of umbrellas have fixed umbrella bases are either sharp points that they jam into the sand, or some sort of weighed base that may be difficult to carry.

The prior art also teaches large umbrellas that are used in the open-air and outdoor environments, such as the "Easy-Up" canopies for trade shows, street fairs and the like. Use of large umbrellas in the outdoor environments have inherent problems with stability, because the shaking motion caused by wind often leads to poor stability. To overcome the problem of unstable umbrellas, the weight of the base is increased in order to achieve stability. This creates a problem as the user of the invention has to haul a cement block, rocks, bottles of water, etc. along just to try to stabilize his/her umbrella. In addition, the generic term "Easy-Up" is a complete misnomer, as it generally takes four tall, relatively strong people to put one of these canopies up, and the same number to take it down.

For both the "recreational" umbrella user and the "business" umbrella user, once the umbrella user sets up in any windy, or potentially windy, location, he/she must plan ahead for the possibility of windy conditions. In addition to having to carry some weight for the base, the user must plan on bringing enough people to set up and take down the umbrella once its usage of over for the day.

SUMMARY OF THE INVENTION

It is therefore an object of the present invention to provide a portable shade umbrella that is easy to disassemble and easy to carry, lightweight and convenient, and can effectively solve the problems of the background art that have been outlined above.

The current invention provides a solution to the problems with the prior art by providing an umbrella unit that is 1) easy to put up and take down by only one person, 2) can be stabilized quickly and easily, 3) is adjustable in height, and 4) can be connected to other umbrellas to form a "line" or "plane" of linked umbrellas.

In one aspect of the present invention, the invention provides a portable shade umbrella that includes an umbrella top structure which is portable, detachable and collapsible, a pole bracket which enables the separation of umbrella top structure and an umbrella pole into two components for ease of carrying and storing, an umbrella stand structure attached to lower end of an umbrella pole which provides stability through both horizontal and vertical loads.

In another aspect of the present invention the umbrella pole is a telescopic pole having telescopic positioning structure.

In another aspect of the present invention, the invention teaches a portable shade umbrella that includes an umbrella top structure for ease of carrying and storing, an umbrella pole which enables the separation of umbrella top structure, and an umbrella stand structure attached to lower end of an umbrella pole which provides stability.

In another aspect of the present invention, the inventor provides an umbrella top structure and umbrella stand structure that are arranged with an umbrella pole. The umbrella pole is formed to form a portable shade umbrella that can be used outdoor under windy conditions, and which can be set up for vertical extension. The umbrella top structure and umbrella stand structure are individually supported by the upper and lower sides of the umbrella pole.

In another aspect of the present invention, the invention provides a portable shade umbrella having good stability, one which is convenient to set-up, take down and use, with parts that are detachable and collapsible.

In another aspect of the present invention, we provide a portable shade umbrella having an umbrella stand structure including a bottom frame, where the bottom side of the peripheral frame have distributed therefrom a plurality of horizontal channels are supported on the ground.

In a preferred aspect of the present invention, the portable shade umbrella is rectangular in shape. This shape allows users to connect to umbrellas that are integrated into each corner of the top umbrella structure, such that a "chain" or even a "blanket" of umbrellas can be set up next to each other with the twin goals of a) providing a wider area of shade, and synergistically providing strength and support to the adjacent umbrellas.

In another aspect of the present invention, the integrated umbrella stand structure allows users to easily set up an area of shade without requiring it to be anchored into any flooring, or requiring the user of the invention to haul along any concrete blocks, dumbbell weights, rocks, or other heavy objects.

In another aspect of the present invention provides a portable shade umbrella for sporting events, beach and outdoor work environments.

In another aspect of the present invention a skirt attached to frames of the umbrella stand structure that will bear weight as a means to stabilize the umbrella during wind events. The integrated skirt allows users to add distributed weight to the top of the stand as a means of stability. For example: a user at the beach could simply throw sand on the skirt to create the weight necessary for stability.

In another aspect of the present invention provides storage netting inside the umbrella top structure.

In another aspect of the present invention the portable shade umbrella that is easy to set up and take down. The pole telescopes to ensure users do not need to take it apart when transporting the umbrella.

In another aspect of the present invention the stand by itself is very lightweight and portable allowing customers to take this stand with them wherever they need shade.

In another aspect of the invention, the plastic parts can be constructed through a variety of processes, including 3D printing, Injection molding, Blow molding, Compression molding, Gas Assist Molding, Film Insert Molding, Rotational Molding, and/or Thermoforming.

In a further aspect of the invention, the parts are intended to be interchangeable with existing umbrellas, such that the stand portion could be used to support an umbrella from another manufacturer, and the canopy portion could be attached to a support stand from another manufacturer.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

Embodiments of the Invention Contemplated

A first embodiment contemplates an umbrella, comprising a top structure, an umbrella base, and an umbrella pole, where the umbrella base comprises a stand structure with at least three support struts, an umbrella pole, a guide cap and at least two pivot couplers, including a second pivot coupler and a third pivot coupler, and an umbrella canopy, where the at least three support struts radiate outwardly from the second pivot coupler to which they are rotably connected where the umbrella pole holds the umbrella canopy a set distance off the ground.

Additionally, it is contemplate that the top structure could additionally comprise at least three connection struts, an elastic closure pin, and where the at least three connection struts are rotably attached to the at least three support struts and to the third pivot coupler, where the third pivot coupler additionally comprises a roughly circular opening through which the umbrella pole is capable of fitting, and where, upon opening the invention, the at least three support struts are rotated outwardly from the umbrella pole, and held in place by the second pivot coupler, and the at least three connection struts are rotated in a downward direction, whereby the third pivot coupler is also pulled in a downward direction, thereby supply support to the umbrella pole.

Furthermore, the umbrella base could additionally comprise an elastic closure pin and a guide cap, where the guile cap focusses the movement of the third pivot coupler up and down the umbrella pole, and the elastic closure pin serves to temporarily lock the third pivot coupler at a certain height up the umbrella pole, where each support strut comprises a support strut pin bracket, a pivot bracket, an end cap, and a support strut bar, where the pin bracket connects the support strut to the second pivot coupler, the pivot bracket rotably connects the support strut to the connection strut, and a support strut bar, and, where each support strut additionally comprises a moulded bracket, where the moulded bracket is located at an outermost end of the support strut bar, where the moulded bracket has a top end, a bottom end, and a middle end, where the top end and the bottom end extent outwardly to a greater extent than does the middle end.

Additionally, the umbrella base could have a connection strut that comprises a connection strut bar and two pin brackets, where the two pin brackets are located at opposite ends of the connection strut bar, and, optionally, a skirt, where the skirt comprises a piece of fabric, additionally comprising two or more elastic loops, where each of the two or more elastic loops is located at an edge of the skirt, and where each elastic loop can be removably secured to the moulded bracket at the end of each support strut bar.

In a preferred embodiment the umbrella base could have four support struts, the skirt could be roughly square in shape, and the skirt could additionally comprise four elastic loops, where there is one elastic loop at each corner of the skirt.

To prevent the umbrella from falling over, it is contemplated that the user of the invention can pile a stabilizing substance, such as sand, on the skirt to keep the umbrella canopy from falling over.

The umbrella top structure could additionally comprise at least three support struts and at least three connection struts, an umbrella pole, a pivot coupling, a pivot coupler, and an umbrella canopy, where the at least three support struts radiate outwardly from the pivot coupling to which they are rotably connected, and there the at least three connection struts are rotably attached to the at least three support struts and to the pivot coupler, where the pivot coupler additionally comprises a roughly circular opening through which the umbrella pole is capable of fitting, where the umbrella pole holds the umbrella canopy a set distance off the ground, and where, upon opening the invention, the at least three support struts are rotated outwardly from the umbrella pole, and held in place by the second pivot coupler, and the at least three connection struts are rotated in a downward direction, whereby the pivot coupler is also pulled in a downward direction, thereby supply support to the umbrella pole.

It is also contemplated that each support strut could comprise a support strut pin bracket, a pivot bracket, an end cap, and a support strut bar, where the pin bracket connects the support strut to the second pivot coupler, the pivot bracket rotably connects the support strut to the connection strut, and a support strut bar, where each support strut additionally comprises means of securing the umbrella canopy of the umbrella top structure, where the connection strut comprises a connection strut bar and two pin brackets, where the two pin brackets are located at opposite ends of the connection strut bar, and where each support strut additionally comprises means by which and edge of the canopy can be attached to an edge of one or more adjacent canopies, and, where the means of attaching one canopy to the edge of an adjacent canopy comprise male and female connectors, placed on alternate corners of the canopy.

It is also contemplated that the umbrella top structure could additionally comprise one or more nets and pockets that are attached to an underside of the canopy.

Another preferred embodiment calls for the umbrella pole to be hollow and/or telescopic.

BRIEF DESCRIPTION OF THE DRAWINGS

The present invention will be described with reference to the following drawings. The drawings and the associated descriptions are provided to illustrate embodiments of the invention and not to limit the scope of the invention. The various aspects of this umbrella are designed to be used together or independently of each other.

DETAILED DESCRIPTION

Figure 1:
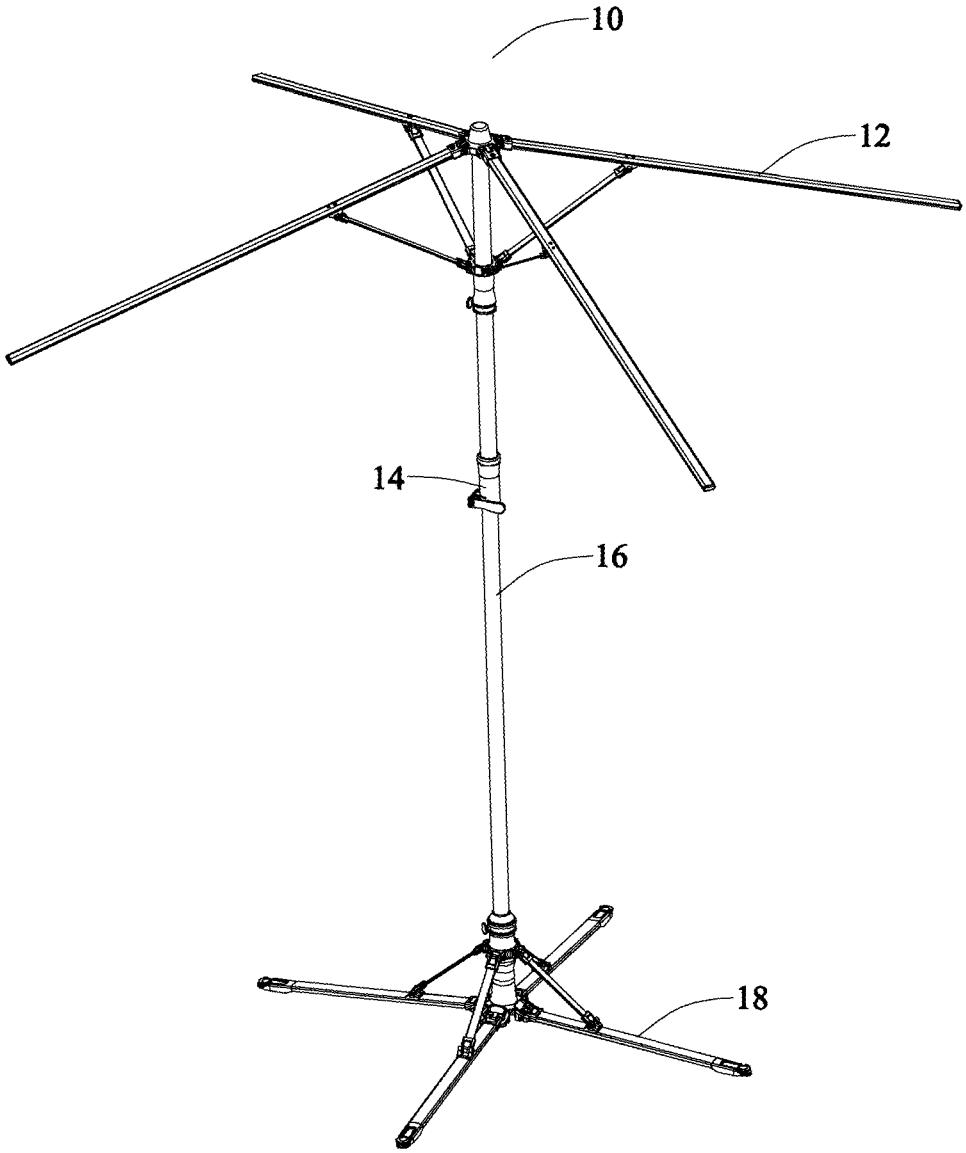
FIG. 1 is a perspective view of a portable shade umbrella structure in accordance with an embodiment of the present invention.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Figure 2:
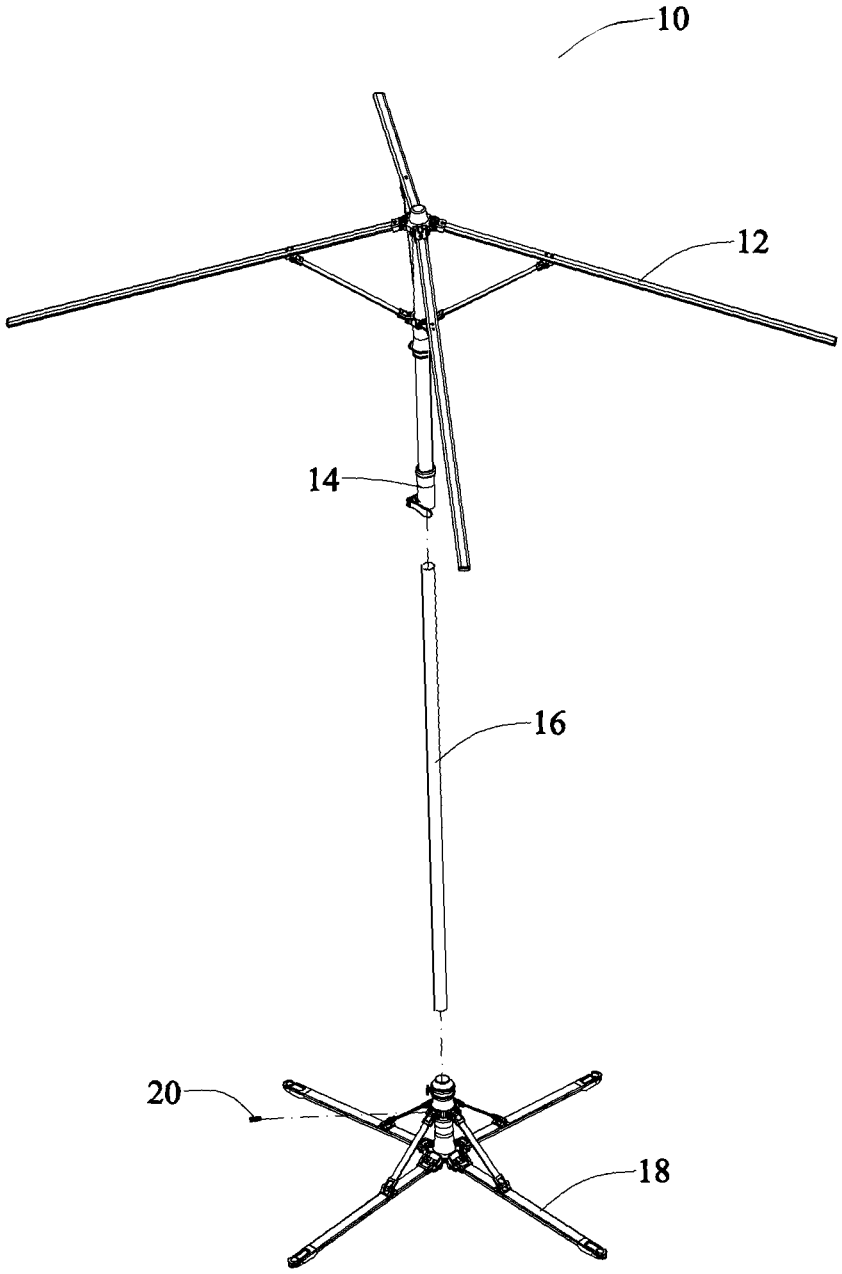
FIG. 2 is an exploded view of the portable shade umbrella structure in accordance with an embodiment of the present invention.

Reference Numbers Used:

10. Invention generally
12. umbrella top structure generally
14. pole bracket
16. umbrella pole
18. stand structure
20. grub screw
22. support struts
24. pivot coupling
26. connection struts
28. support pole
30. first pivot coupler
32. elastic closure pin
34. lever cam bolt
36. support struts
38. second pivot coupler
40. third pivot coupler
42. guide cap
44. support strut pin bracket
46. pivot bracket
48. support strut bar
50. end cap
52. connection strut bar
54. connection strut pin bracket
56. plastic ring structure
58. metal pin
60. support strut bar
62. moulded bracket
64. pivot bracket
66. pin bracket
102. upper skirt
104. bottom skirt
106. Elastic loop
107. Male Canopy Attachment
108. Female Canopy Attachment
110 Canopy Attachment Reinforcing Stitching.
111. Top Canopy layer
112. Middle Canopy layer
113. Lower Canopy layer
114. Side Canopy layer
115. Center pole Cap
116. Mesh bag
117. Reinforced corner Now referring to FIG. 1 and FIG. 2, in one embodiment, the present invention provides a portable shade umbrella structure 10 includes an umbrella top structure 12 which is portable, detachable and collapsible, a pole bracket 14 which enables the separation of umbrella top structure 12 and an umbrella pole 16 into two components and posit of each other for ease of carrying and storing, an umbrella stand structure 18 attached to lower end of an umbrella pole 16 which provides stability by parting horizontal and vertical loads and a grub screw 20 which limits the insertion of an umbrella pole 16 into the umbrella stand structure 18.

Figure 3:
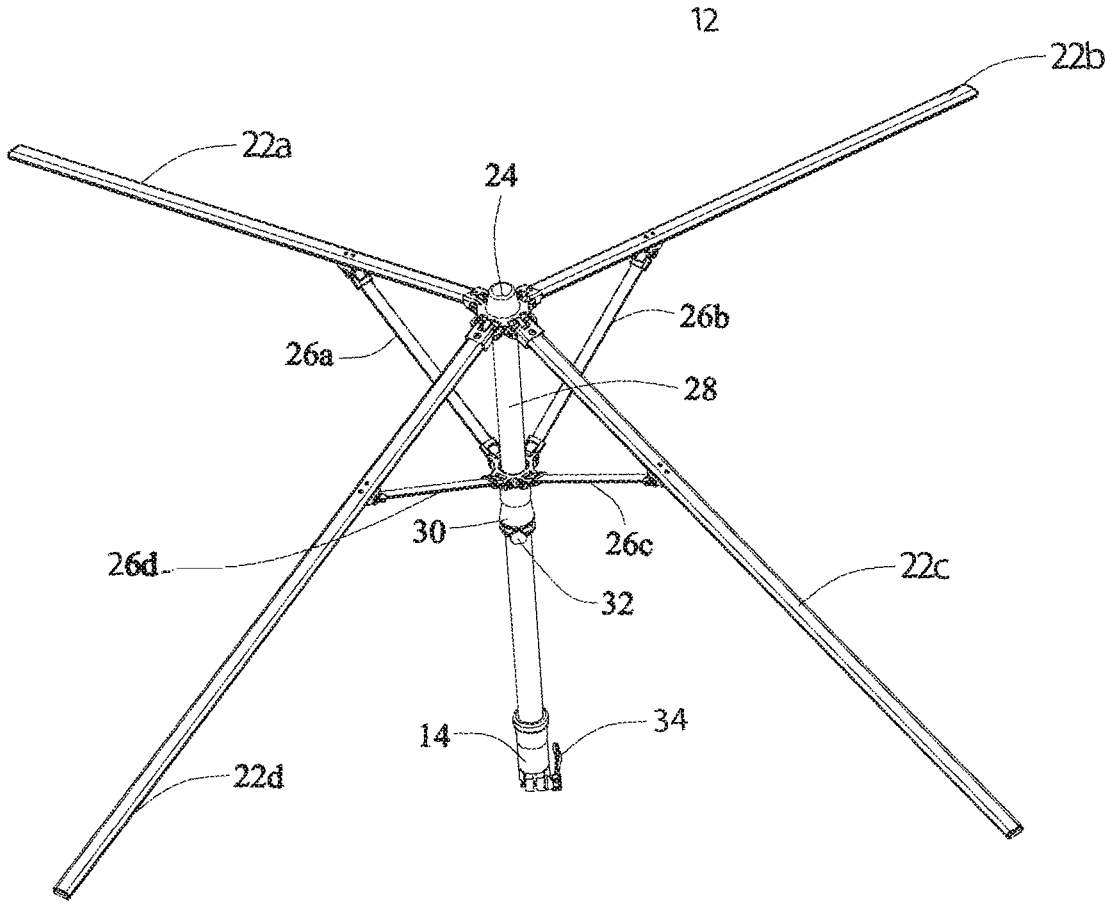
FIG. 3 is a perspective top view of the portable shade umbrella in accordance with an embodiment of the present invention.
Figure 4:
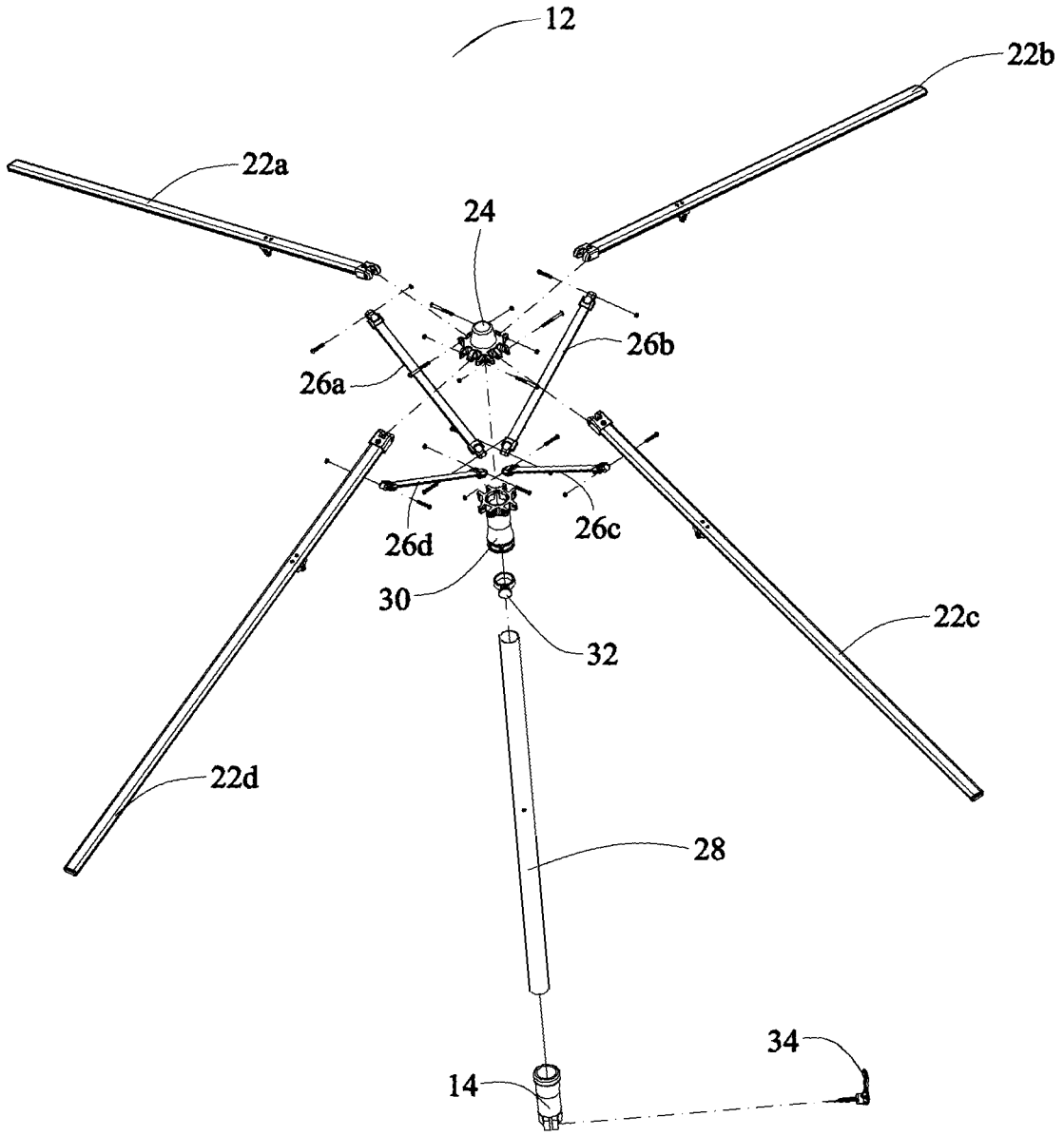
FIG. 4 is an exploded top view of the portable shade umbrella in accordance with an embodiment of the present invention.

Now referring to FIG. 3 and FIG. 4, in one embodiment, the present invention provides an umbrella top structure 12 includes plurality of support struts 22*a*, 22*b*, 22*c* and 22*d*, a pivot coupling 24 mounted on the top of supporting pole 28 to which one end of support struts 22*a*, 22*b*, 22*c* and 22*d* are attached by means of but not limited to like pins, bolts, nuts, etc., a pivot coupler 30 having bearings inside is inserted over the supporting pole 28 to which one end of connection struts 26*a*, 26*b*, 26*c* and 26*d* are attached by means of but not limited to like pins, bolts, nuts, etc., other end of connection struts 26*a*, 26*b*, 26*c* and 26*d* is attached to the support struts 22*a*, 22*b*, 22*c* and 22*d*, a first pivot coupler 30 is provided with over-molded elastic closure pin 32 which fix its position over supporting pole 28, a pole bracket 14 is attached at the bottom end of supporting pole 28 by suitable means and lever cam bolt 34 is provided for tightening.

Figure 5:
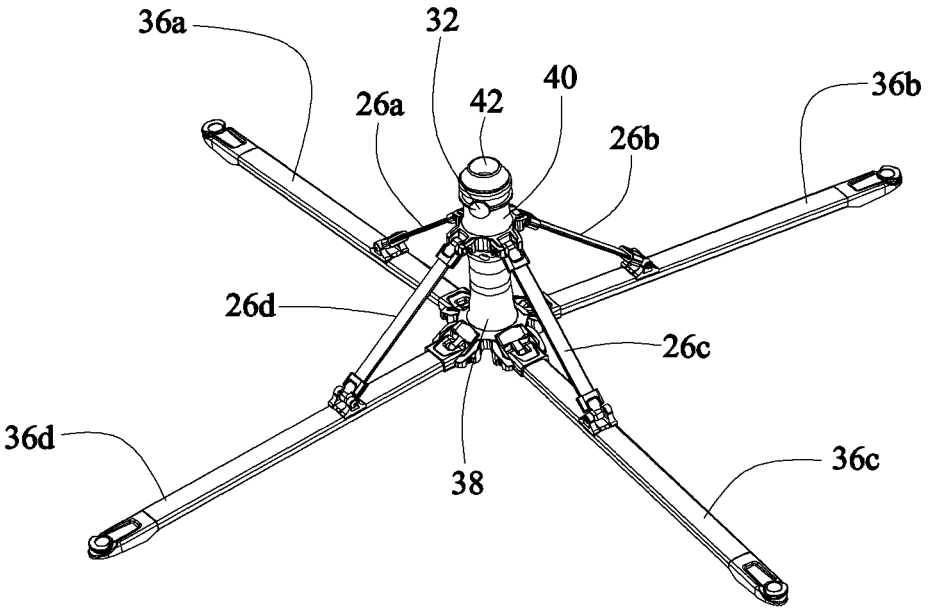
FIG. 5 is a perspective view of a stand of the portable shade umbrella in accordance with an embodiment of the present invention.
Figure 6:
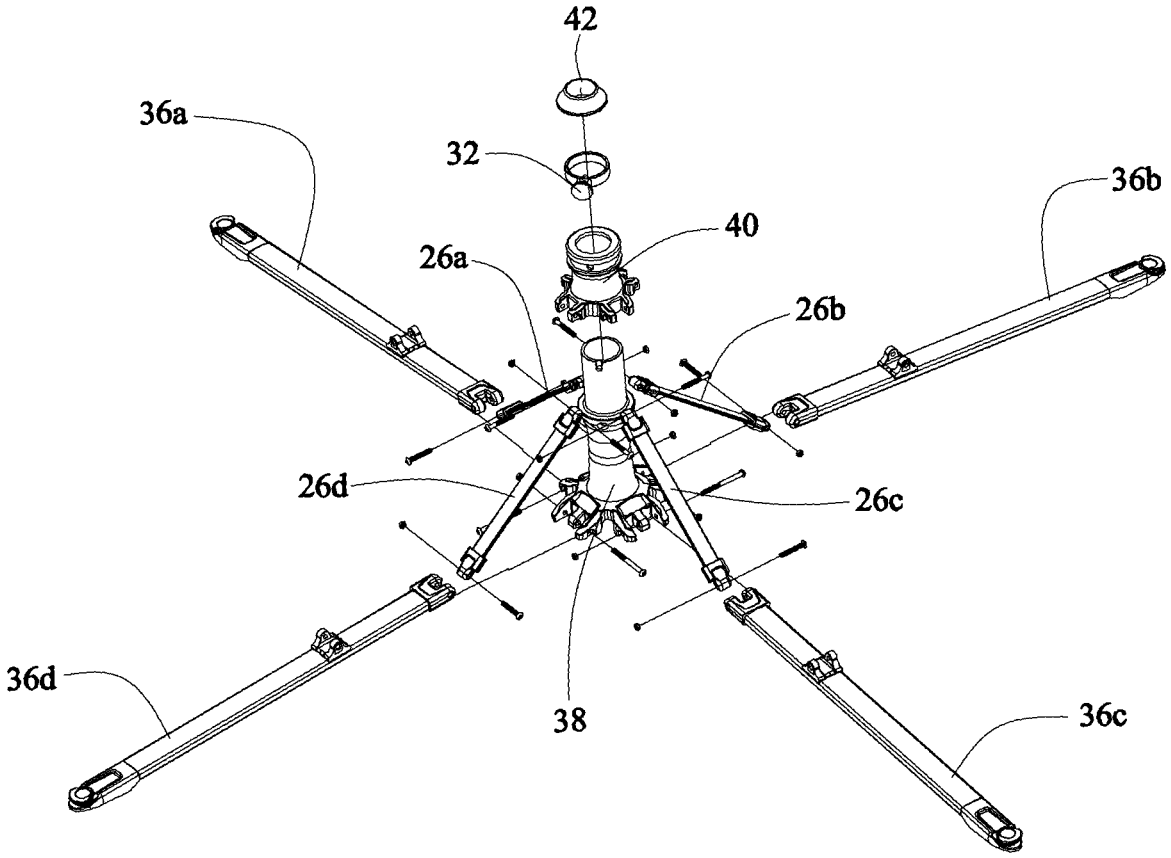
FIG. 6 is an exploded view of a stand of the portable shade umbrella in accordance with an embodiment of the present invention.

Now referring to FIG. 5 and FIG. 6, in one embodiment, the present invention provides an umbrella stand structure 18 includes plurality of support struts 36*a*, 36*b*, 36*c* and 36*d*, a second pivot coupler 38 is provided to which one end of support struts 36*a*, 36*b*, 36*c* and 36*d* are attached by means of but not limited to like pins, bolts, nuts, etc., another pivot coupler 40 is provided to which one end of connection struts 26*a*, 26*b*, 26*c* and 26*d* are attached by means of but not limited to like pins, bolts, nuts, etc., other end of connection struts 26*a*, 26*b*, 26*c* and 26*d* is attached to the support struts 36*a*, 36*b*, 36*c* and 36*d*, third pivot coupler 40 is provided with over-molded elastic closure pin 32 which fix its position over supporting pole 28, a guide cap 42 is provided to align the supporting pole 28.

Figure 7:
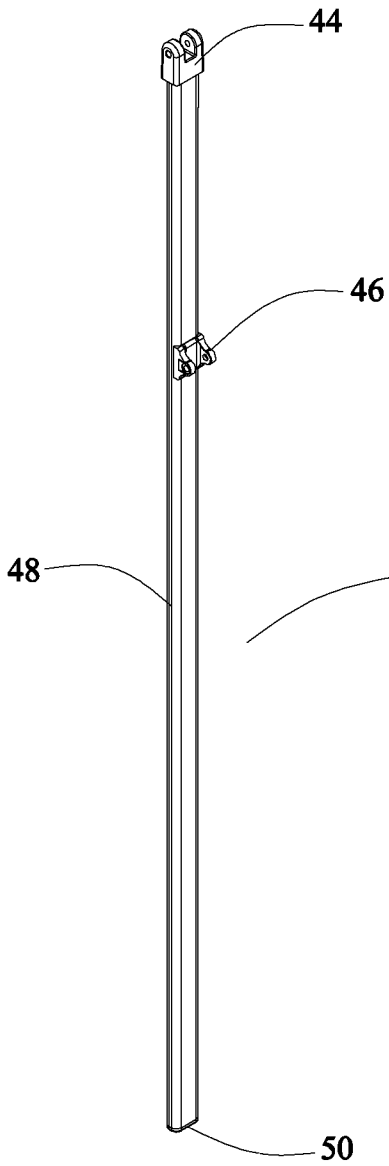
FIG. 7 is a perspective view of the umbrella top's molded strut bar in accordance with an embodiment of the present invention.
Figure 8:
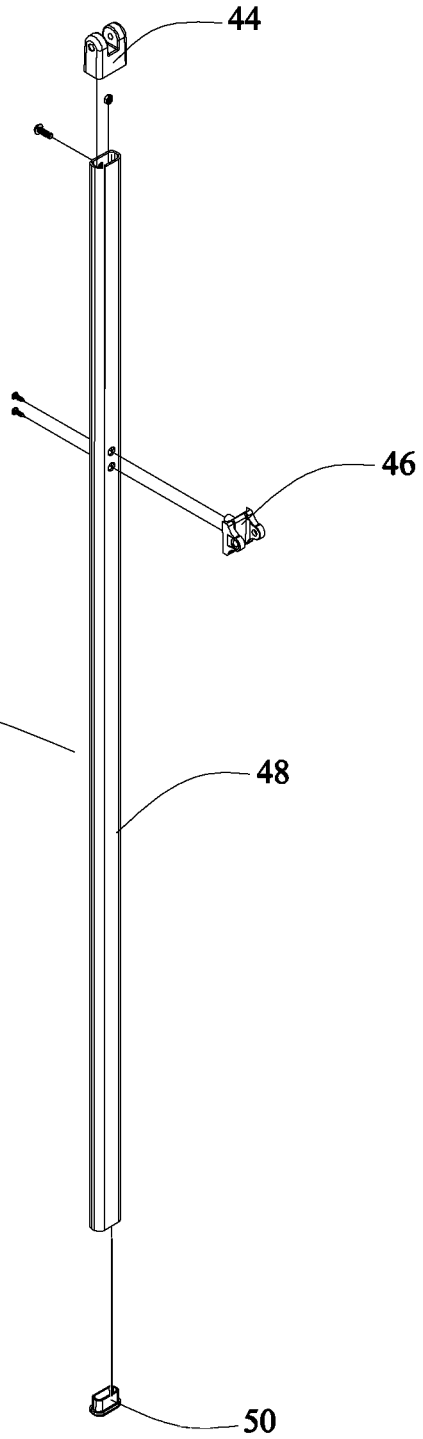
FIG. 8 is an exploded view of the umbrella top's molded strut bar in accordance with an embodiment of the present invention.

Now referring to FIGS. 7 and 8, in one embodiment, the present invention provides a support strut 22 provided with a support strut bar 48, a support strut pin bracket 44 is attached by means of nut and bolt at the top of support strut bar 48, a pivot bracket 46 is attached by means of screws over the of bar 48 and an end cap 50 is attached at the bottom of support strut bar 48.

Figure 9:
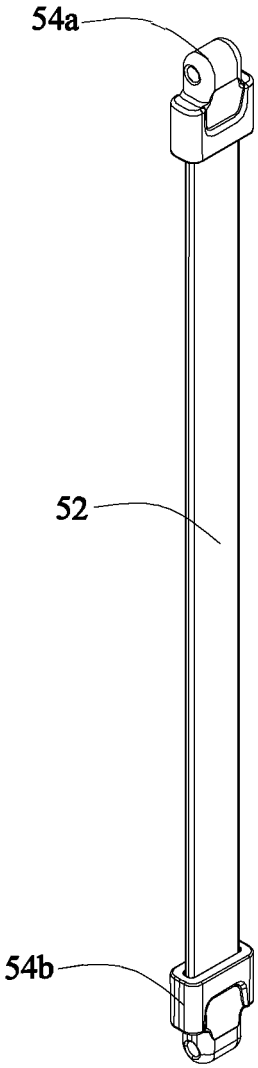
FIG. 9 is a perspective view of a connecting strut bar in accordance with an embodiment of the present invention.
Figure 10:
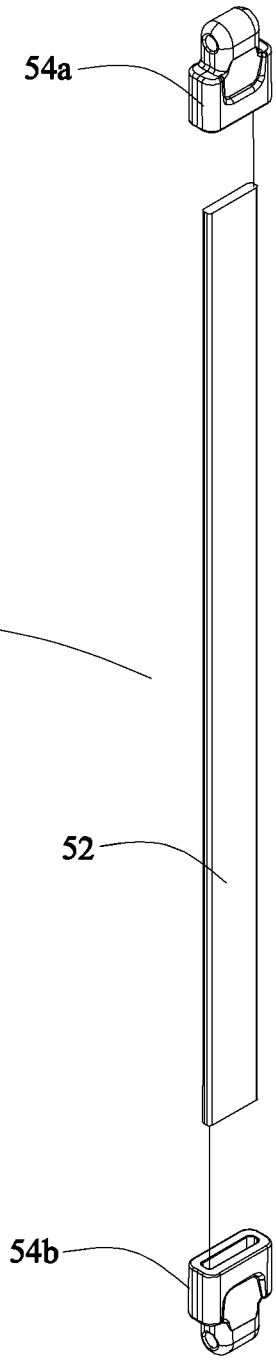
FIG. 10 is an exploded view of a connecting strut bar in accordance with an embodiment of the present invention.

Now referring to FIGS. 9 and 10, in one embodiment, the present invention provides a connection strut 26 provided with a connection strut bar 52, a connection strut pin bracket 54*a* is attached the top of bar 52 and pin bracket 54*b* is attached at the bottom of connection strut bar 52.

Figure 11:
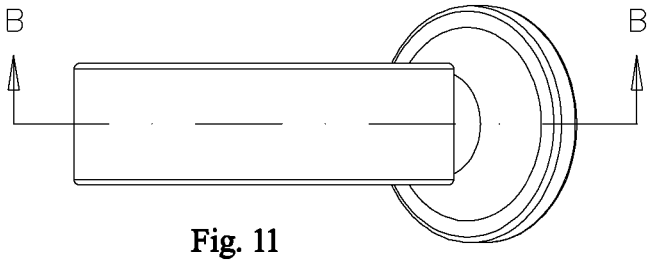
FIG. 11 is a side view of over-molded elastic closure pin in accordance with an embodiment of the present invention.
Figure 12:
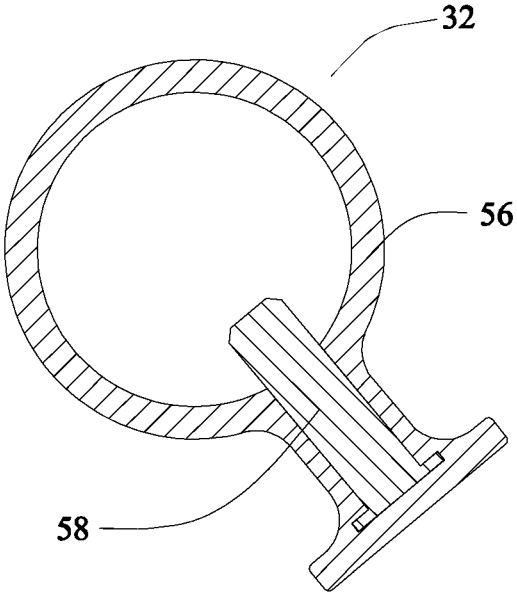
FIG. 12 is a sectional view of over-molded elastic closure pin in accordance with an embodiment of the present invention.
Figure 13:
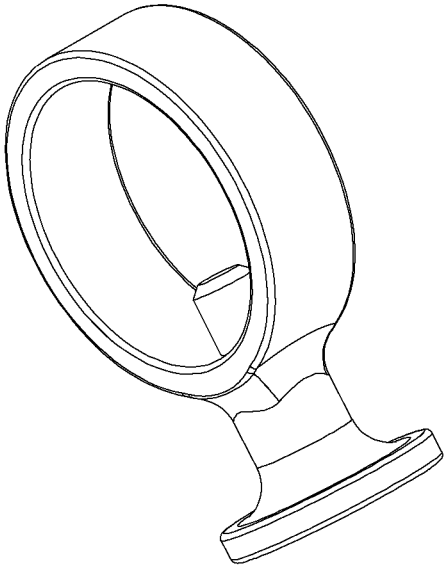
FIG. 13 is a perspective view of over-molded elastic closure pin in accordance with an embodiment of the present invention.

Now referring to FIGS. 11, 12 and 13, in one embodiment, the present invention provides an over-molded elastic closure pin 32, it comprises a metal pin 58 which is molded inside a plastic ring structure 56.

Figure 14:
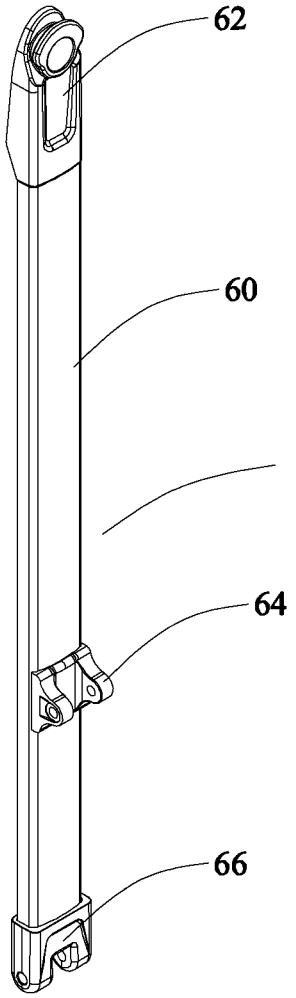
FIG. 14 is a perspective view of an umbrella stand's molded strut bar in accordance with an embodiment of the present invention.
Figure 15:
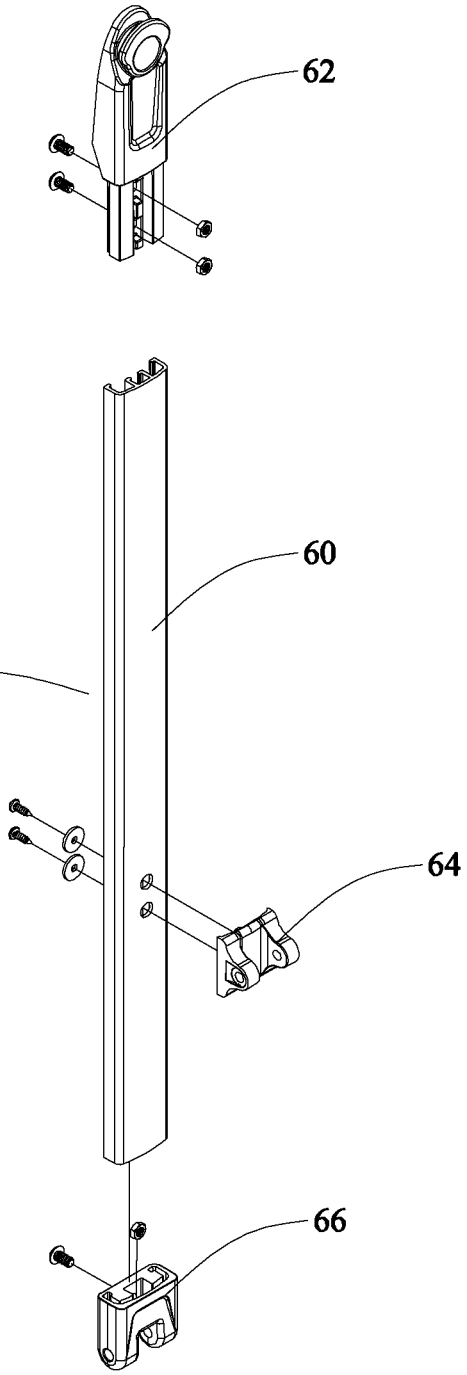
FIG. 15 is an exploded view of an umbrella stand's molded strut bar in accordance with an embodiment of the present invention.

Now referring to FIGS. 14 and 15, in one embodiment, the present invention provides a support strut 36 provided with a support strut bar 60, a molded bracket 62 is attached by means of nut and bolt at the top of support strut bar 60, a pivot bracket 64 is attached by means of screws over the of bar 48 and a pin bracket 66 is attached by means of nut and bolt at the bottom of bar 60.

Figure 16:
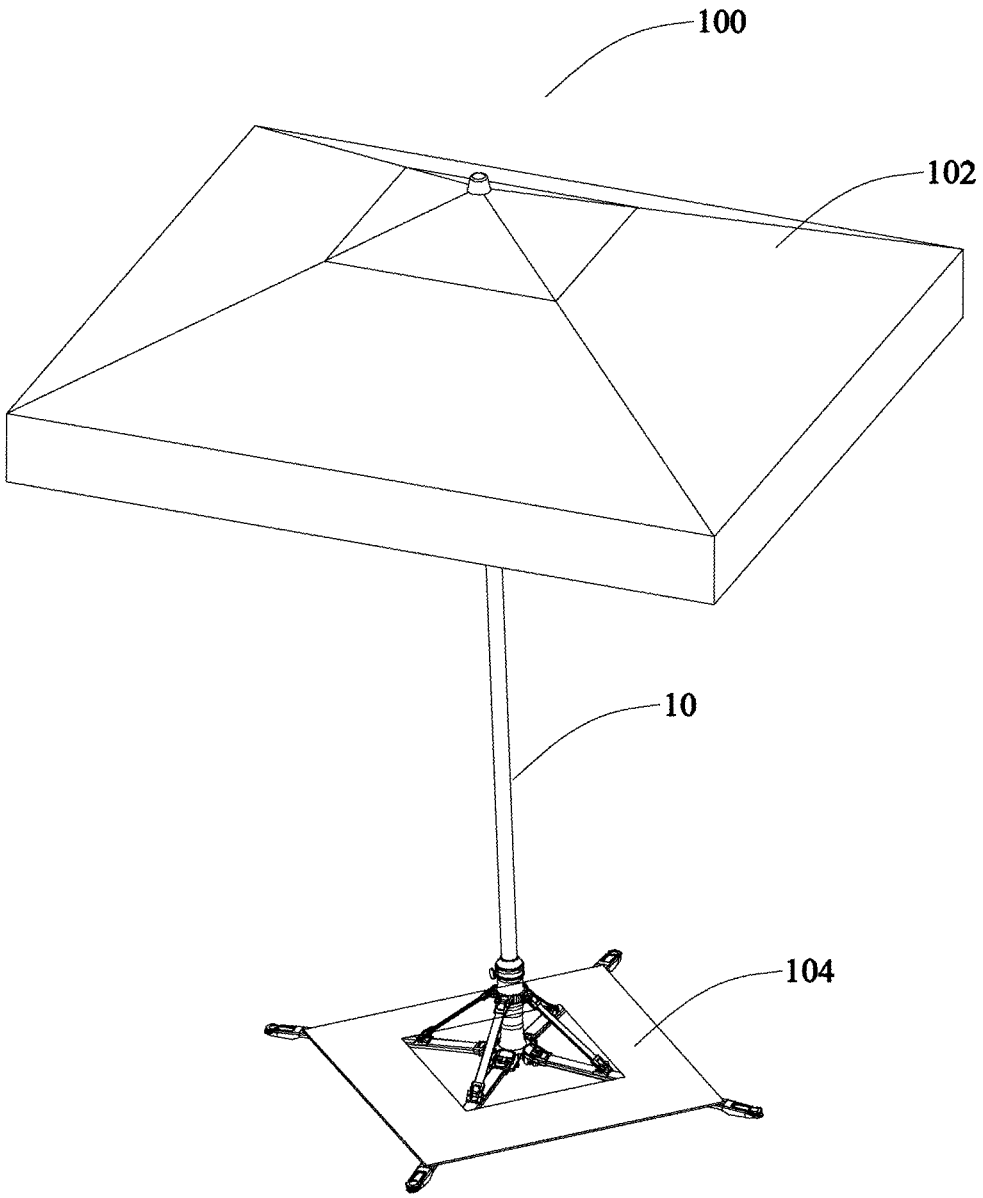
FIG. 16 is a perspective view of an exemplary portable shade umbrella in accordance with an embodiment of the present invention.

Now referring to FIG. 16, in one embodiment, the present invention provides portable shade umbrella 100, provided with an upper skirt 102 which provides shade to the user, an umbrella structure 10 and a bottom skirt 104 which helps in stabilizing the whole load.

Figure 17:
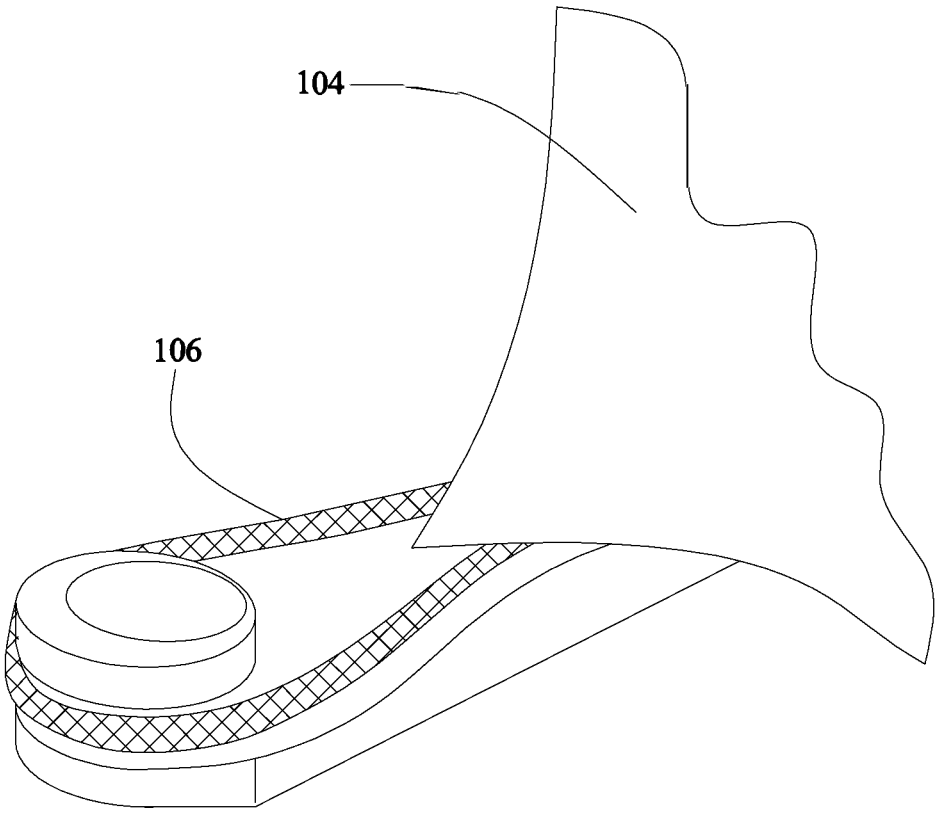
FIG. 17 is a perspective view showing locking loop of a base skirt in accordance with an embodiment of the present invention.

Now referring to FIG. 17, in one embodiment, the present invention provides an elastic loop 106 stitched with bottom skirt 104, this allow user to place sand around the bottom skirt 104 to provide better stability and distribution of load.

Figure 18:
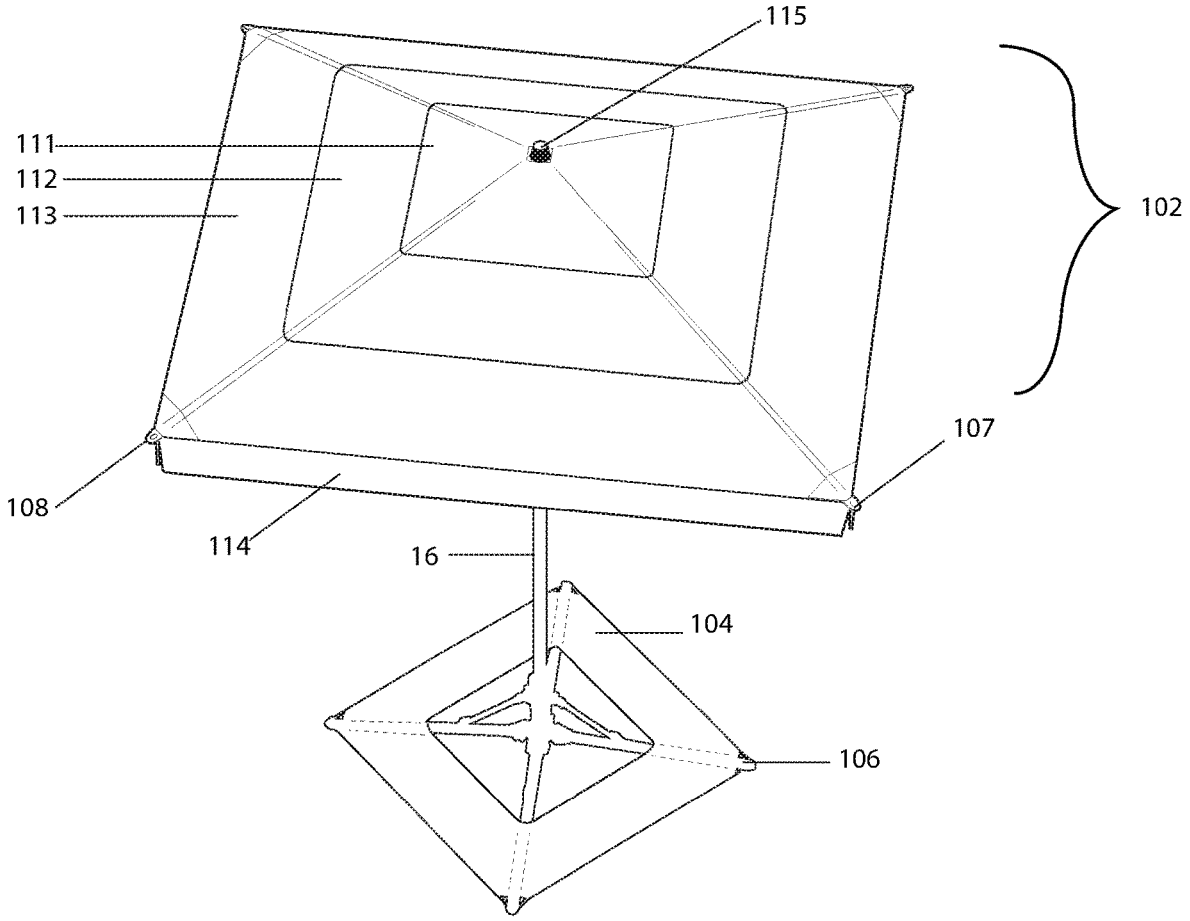
FIG. 18 is a perspective view showing the invention with its upper skirt, or canopy, fully extended.

Now referring to FIG. 18, the present embodiment provides is illustrated with a perspective view showing the invention with its upper skirt, or canopy, fully extended. In this figure, the bottom and top structures have both been set up, with a bottom skirt 104 extending over the stand structure (18 in other figures). Elastic loops 106 keep the bottom skirt 104 fully taught and extended over the stand structure. A user of the invention can pile sand, rocks, water bottles or any other heaving substance on the skirt to stabilize the invention. Umbrella pole 16 extends from the stand structure to the upper skirt 102 or canopy. The upper skirt 102 fits over center pole cap 115 and has three layers: a top canopy layer 111, a middle canopy layer 112 and a bottom canopy layer 113, which are layered over each other to provide a waterproof solution to circulation issues. The layered arrangement of the different canopy layers allows for wind to pick up the edge of each layer and raise it slightly, thereby allowing wing to enter the area under the canopy for enhanced air circulation. Allowing some air through the canopy also decreases the horizontal pressure on the canopy, thereby decreasing the likelihood that it would tip over or blow away.

Attached to the lower edge of lower canopy layer 113 is side canopy layer 114 or side panel, which provides some "side shade" as well as hiding the frame of the canopy. At the corner of canopy 102 are male canopy attachments 107 and female canopy attachments 108. These mate with their counterparts on adjacent canopies such that an entire line, or colony, of canopies can be attached to each other to provide additional strength and ensure greater sun protection.

Figure 19:
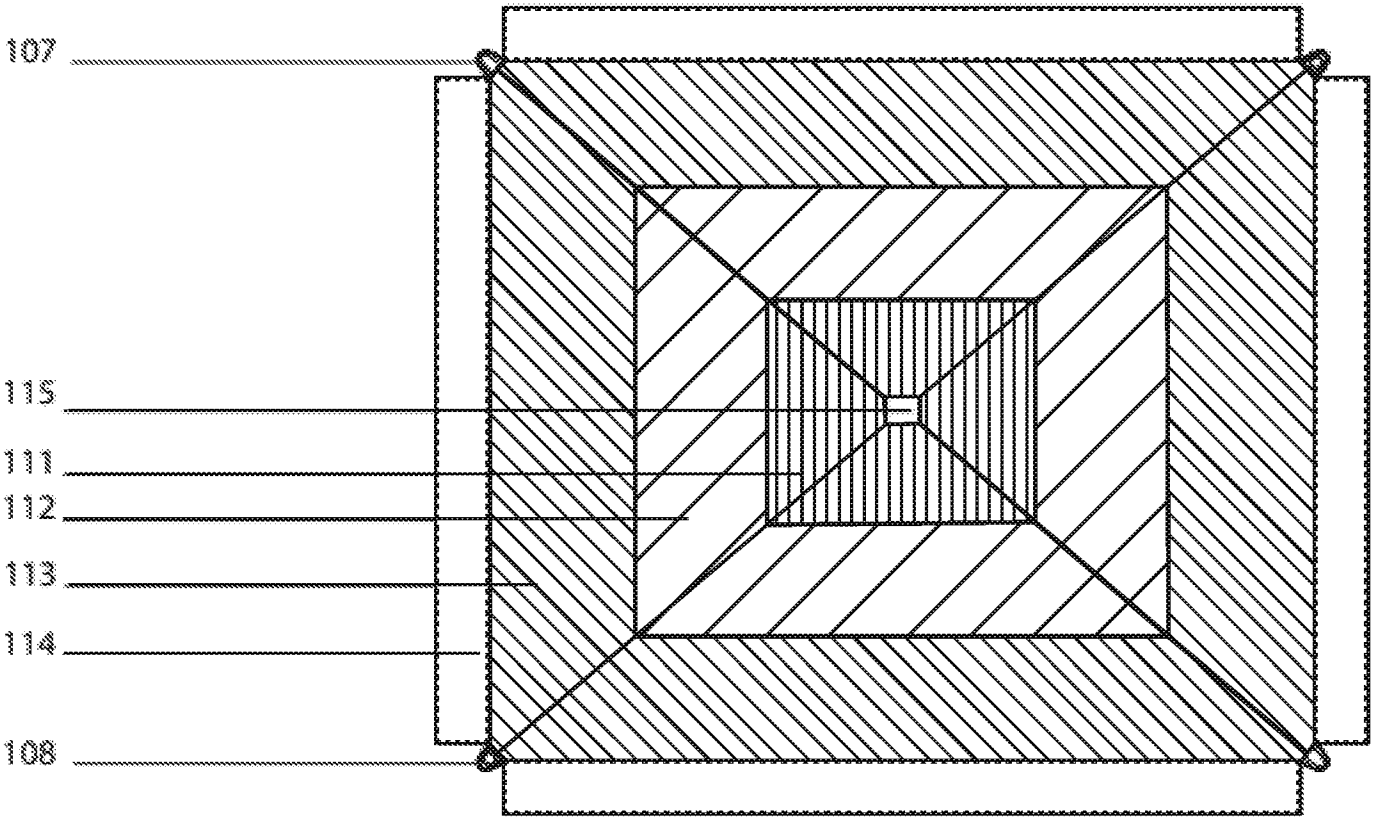
FIG. 19 is a top and side view of the canopy.
Figure 19:
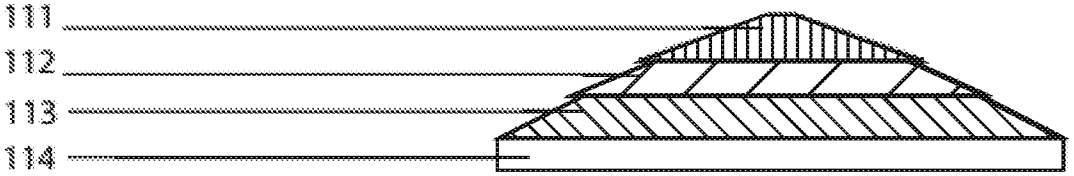

FIG. 19 is a top and side view of the canopy. This illustration shows how upper canopy layer 111 overlaps slightly with middle canopy layer 112, which, in turn, overlaps slightly with lower canopy layer 113. It also shows how side canopy layer 114 hangs vertically from the bottom edge of lower canopy layer 113.

Figure 20:
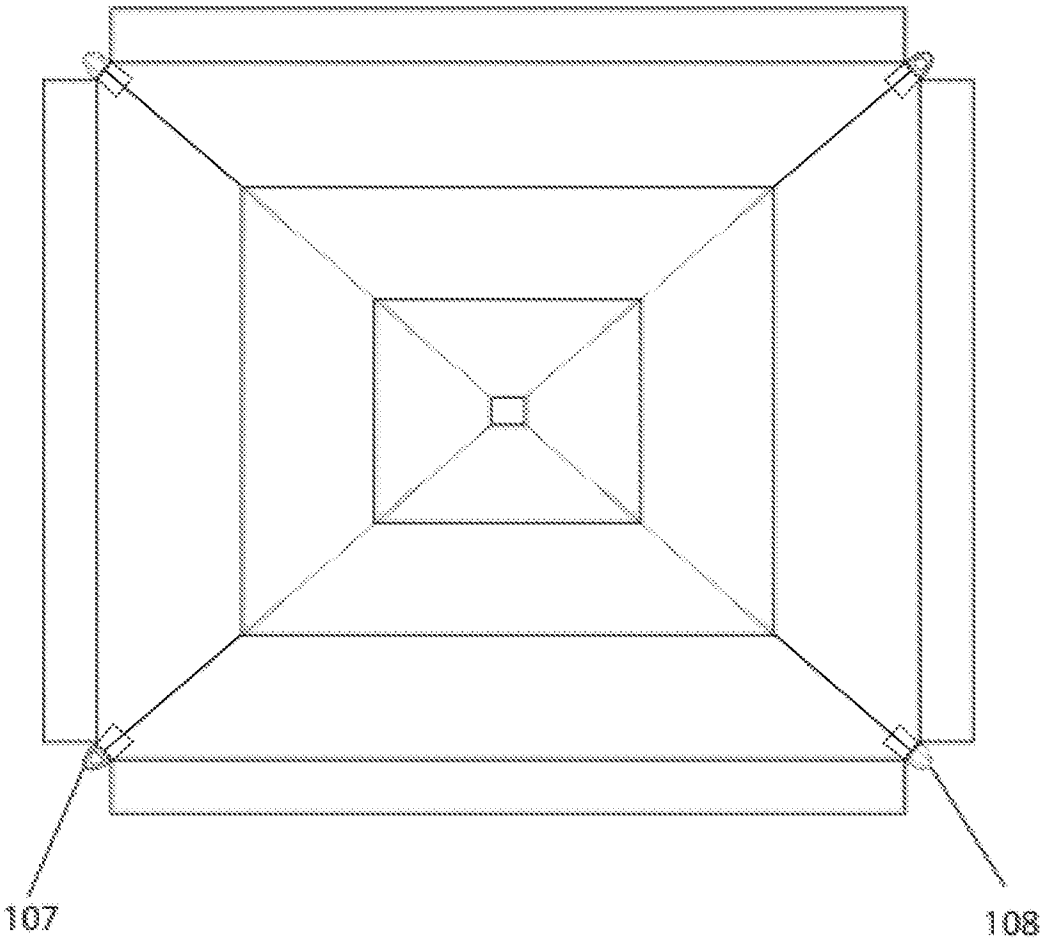
FIG. 20 is a top view of the canopy and a top view of the male and female connectors that allow one canopy to be connected to adjacent canopies.
Figure 20:
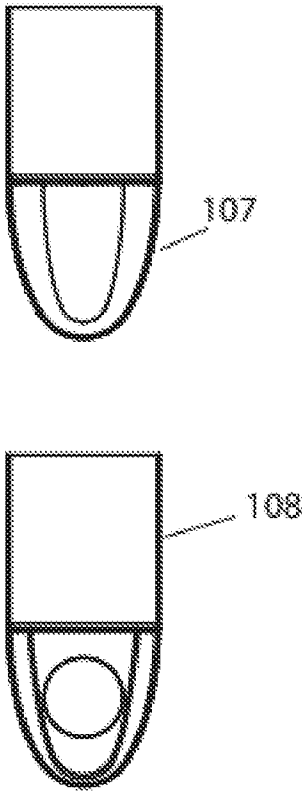

FIG. 20 is a top view of the canopy and a top view of the male 107 and female connectors 108 that allow one canopy to be connected to adjacent canopies.

Figure 21:
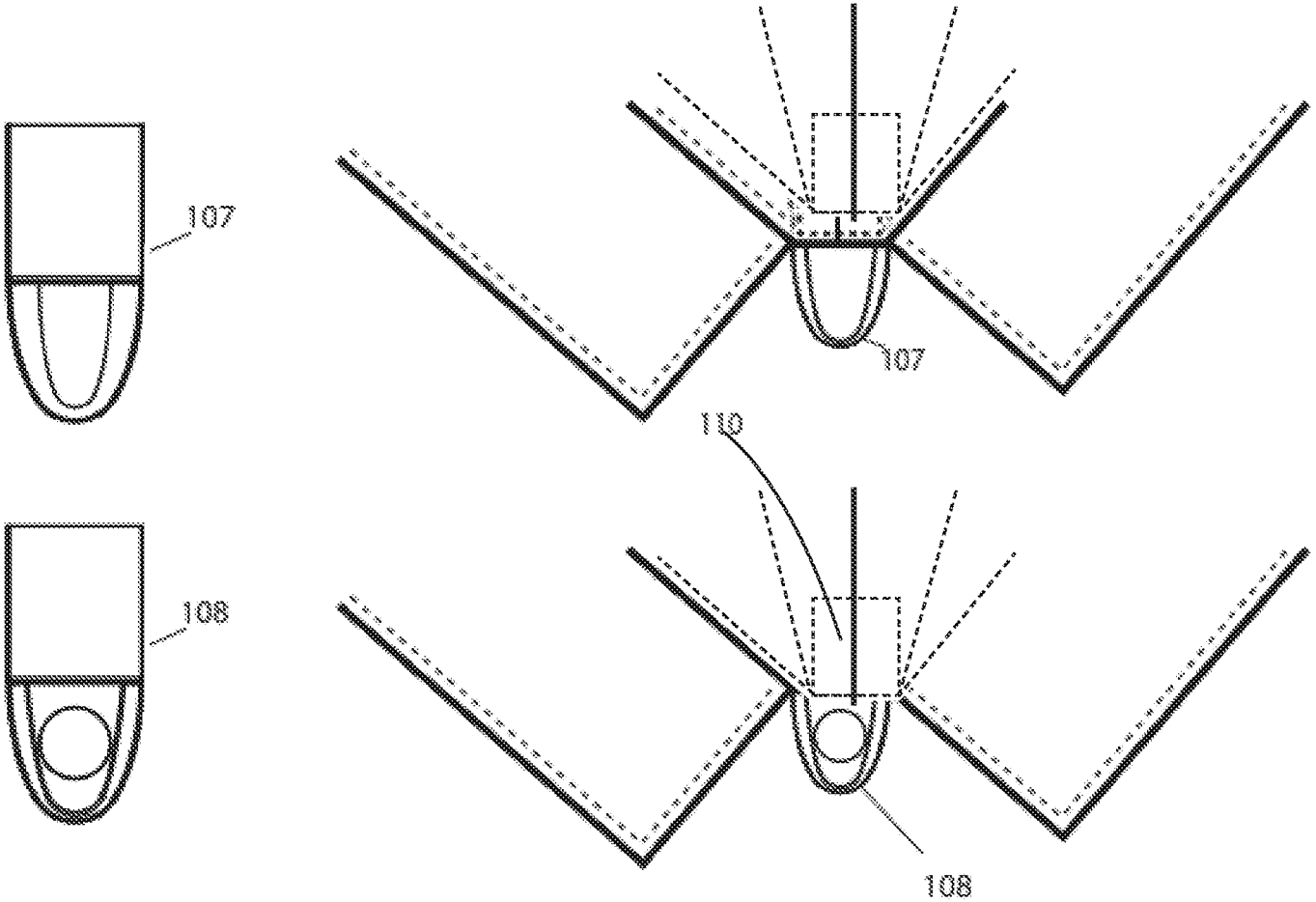
FIG. 21 is a top of view the male and female connectors that allow one canopy to be connected to adjacent canopies, and of the reinforcing stitching that is used to attach the male and female canopy connectors to adjacent canopies.

FIG. 21 is a top of view the male and female connectors that allow one canopy to be connected to adjacent canopies, and of the reinforcing stitching 110 that is used to attach the male canopy connectors 107 and female canopy connectors 108 to adjacent canopies.

Figure 22:
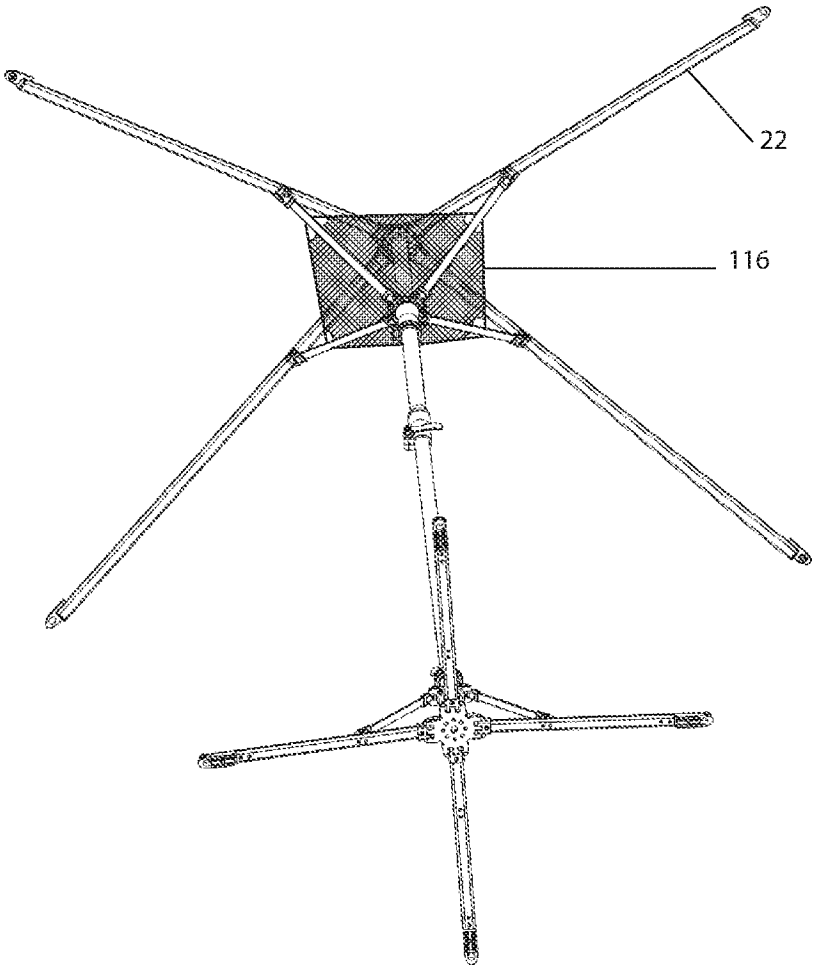
FIG. 22 is a bottom, perspective view of the underside of the canopy showing the mesh bags.

FIG. 22 is a bottom, perspective view of the underside of the canopy showing the mesh bags 116. One or more mesh bags 116 are removably attached to the four connection struts 26, which support the support struts 22. This creates a hanging mesh bag suitable for storing items such as sunscreen, wallets, keys and the like.

Figure 23:
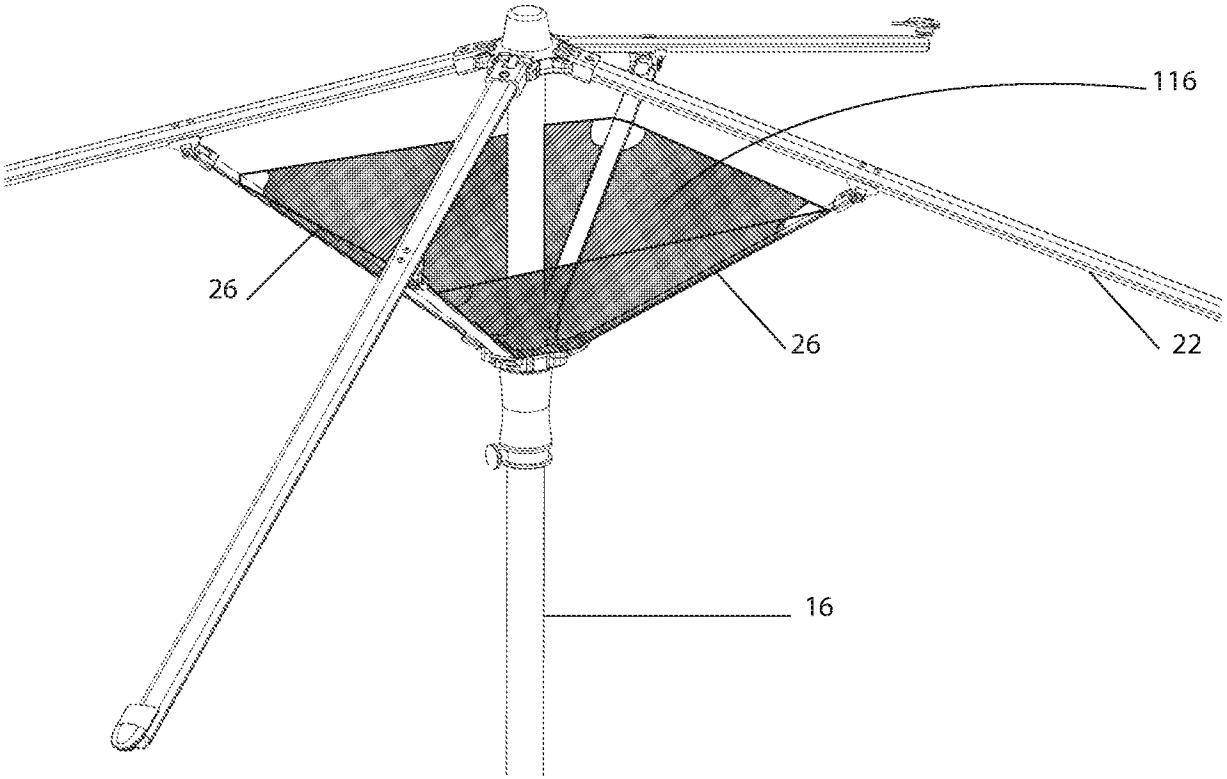
FIG. 23 is a side, perspective view of the mesh bag and its means of removable attachment.

FIG. 23 is a side, perspective view of the mesh bag and its means of removable attachment. The mesh bag 116, optionally, has a hole at the bottom that is slightly larger in diameter than the umbrella pole 16, such that a user of the invention can slide the mesh bag 116 up over the umbrella pole, then removably secure the ends of the mesh bag to mating points of attachment on the connection struts.

Figure 24:
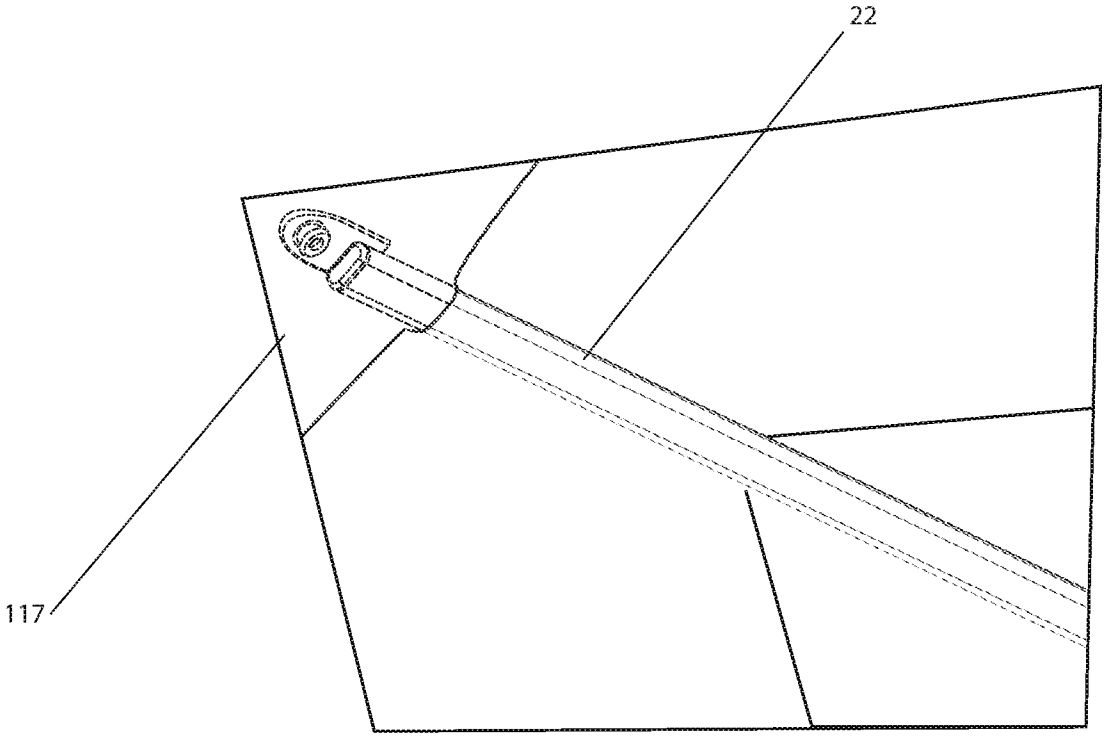
FIG. 24 is a close-up, perspective view of a corner of the canopy showing the means of attachment between the canopy and the support strut.

FIG. 24 is a close-up, perspective view of a corner of the canopy showing the means of attachment between the canopy and the support strut 22. A reinforced corner 117 provides coverage over the end of support strut 22 on both sides. The two layers of fabric are, optionally, stitched together to further strengthen the pocket in which the end of the support strut lays.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. An umbrella, comprising a umbrella top structure, an umbrella base, and an umbrella pole, where the umbrella base comprises a stand structure with at least three umbrella base support struts, a receptable for the umbrella pole, a guide cap and at least two pivot couplers, including a second pivot coupler and a third pivot coupler, where the umbrella top structure comprises an umbrella canopy, where the at least three umbrella base support struts of the umbrella base radiate outwardly from the second pivot coupler to which they are rotably connected, where the umbrella pole holds the umbrella canopy a set distance off the ground, where the umbrella top structure additionally comprises at least three umbrella top structure connection struts, a first pivot coupler, a pivot coupling, a top structure elastic closure pin, and where the at least three top structure connection struts are rotably attached to at least three top structure support struts and to the first pivot coupler, where the first pivot coupler additionally comprises a roughly circular opening through which the umbrella pole is capable of fitting, and where, upon opening the umbrella, the at least three top structure support struts are rotated outwardly from the umbrella pole, and the at least three top structure connection struts are rotated in an upward direction, whereby the first pivot coupler is also pulled in an upward direction, thereby supplying support to the umbrella pole, where the umbrella base additionally comprises an umbrella base elastic closure pin and the guide cap, where the guide cap moves the third pivot coupler up and down the umbrella pole, and the umbrella base elastic closure pin serves to temporarily lock the third pivot coupler at a certain height up the umbrella pole, where each of the at least three umbrella base support struts comprises an umbrella base support strut pin bracket, a pivot bracket, and an umbrella base support strut bar, where the umbrella base support strut pin bracket connects the umbrella base support strut to the second pivot coupler, the pivot bracket rotably connects the umbrella base support strut to the third pivot coupler, where the umbrella base support strut bar includes a moulded bracket, where the moulded bracket is located at an outermost end of the umbrella base support strut bar, where the umbrella base support strut bar comprises an umbrella base connection strut bar and two pin brackets, where the two pin brackets are located at opposite ends of the umbrella base connection strut bar.

2. The umbrella base of claim 1, where the umbrella base additionally comprises a skirt.

3. The umbrella base of claim 2, where the skirt comprises a piece of fabric, additionally comprising two or more elastic loops, where each of the two or more elastic loops is located at an edge of the skirt, and where each elastic loop can be removably secured to the base support strut.

4. The umbrella base of claim 3, where the number of umbrella base support struts is four, and the skirt is roughly square in shape, and where the skirt comprises four elastic loops, where there is one elastic loop at each corner of the skirt.

5. The umbrella base of claim 4, where a user of the invention can pile a stabilizing substance on the skirt to keep the umbrella canopy from falling over.

6. The umbrella base of claim 5, where the stabilizing substance is sand.

7. The umbrella of claim 1, where the umbrella top structure comprises the at least three umbrella top structure support struts, where the at least three umbrella top structure support struts radiate outwardly from the pivot coupling to which they are rotably connected, where the pivot coupler comprises the circular opening through which the umbrella pole is capable of fitting, where the umbrella pole holds the umbrella canopy a set distance off the ground, and, where each umbrella top structure support strut comprises an umbrella top structure support strut pin bracket, a pivot bracket, and an end cap, where each umbrella top structure support strut additionally comprises an umbrella top structure support strut bar, where the umbrella top structure support strut bar is a flat, linear member, where the pin bracket connects the umbrella top structure support strut to the first pivot coupler, the pivot bracket rotably connects the umbrella top structure support strut to the connection strut, where the umbrella top structure support strut bar connects to the pivot coupling and provides support for the umbrella canopy.

8. The umbrella of claim 7, where each umbrella top structure support strut additionally comprises means of securing the umbrella canopy of the umbrella top structure.

9. The umbrella of claim 8, where the umbrella top structure connection strut comprises an umbrella top structure connection strut bar and two pin brackets, where the two pin brackets are located at opposite ends of the umbrella top structure connection strut bar.

10. The umbrella structure of claim 9, where each umbrella top structure support strut additionally comprises means by which an edge of the canopy can be attached to an edge of one or more adjacent canopies.

11. The umbrella of claim 10, where the means of attaching one canopy to the edge of an adjacent canopy comprises male and female connectors, placed on alternate corners of the canopy.

12. The umbrella of claim 11, where the umbrella top structure additionally comprises one or more nets and pockets that are attached to an underside of the canopy.

13. The umbrella of claim 12, where the umbrella pole is hollow.

14. The umbrella of claim 12, where the umbrella pole is telescopic.

* * * * *